US005596886A

United States Patent [19]

Howard

[11] Patent Number: 5,596,886

[45] Date of Patent: Jan. 28, 1997

[54] CRYOGENIC RECTIFICATION SYSTEM FOR PRODUCING GASEOUS OXYGEN AND HIGH PURITY NITROGEN

[75] Inventor: Henry E. Howard, Grand Island, N.Y.

[73] Assignee: Praxair Technology, Inc., Danbury, Conn.

[21] Appl. No.: 628,372

[22] Filed: Apr. 5, 1996

[51] Int. Cl.[6] ..... F25J 3/04

[52] U.S. Cl. ..... 62/646; 62/653

[58] Field of Search ..... 62/646, 648, 653, 62/654

[56] References Cited

U.S. PATENT DOCUMENTS

| | | | |
|---|---|---|---|
| 4,433,989 | 2/1984 | Erickson . | |
| 4,464,191 | 8/1984 | Erickson . | |
| 4,604,116 | 8/1986 | Erickson . | |
| 4,617,036 | 10/1986 | Suchdeo et al. | 62/652 |
| 4,704,148 | 11/1987 | Kleinberg . | |
| 4,824,453 | 4/1989 | Rottmann et al. . | |
| 4,977,746 | 12/1990 | Grenier et al. . | |
| 5,069,699 | 12/1991 | Agrawal | 62/646 |
| 5,245,832 | 9/1993 | Roberts | 62/654 |
| 5,291,737 | 3/1994 | Camberlein et al. . | |
| 5,341,646 | 8/1994 | Agrawal et al. | 62/646 |
| 5,386,692 | 2/1995 | Laforce | 62/646 |
| 5,398,514 | 3/1995 | Roberts et al. | 62/646 |
| 5,402,647 | 4/1995 | Bonaqvist et al. | 62/653 X |
| 5,456,083 | 10/1995 | Hogg et al. | 62/646 |
| 5,463,871 | 11/1995 | Cheung . | |
| 5,490,391 | 2/1996 | Hogg et al. | 62/646 |
| 5,511,380 | 4/1996 | Ha | 62/646 |

*Primary Examiner*—Christopher Kilner
*Attorney, Agent, or Firm*—Stanley Ktorides

[57] ABSTRACT

A cryogenic rectification system for producing gaseous oxygen and high purity nitrogen employing a double column and an auxiliary column which processes higher pressure column fluid.

6 Claims, 1 Drawing Sheet

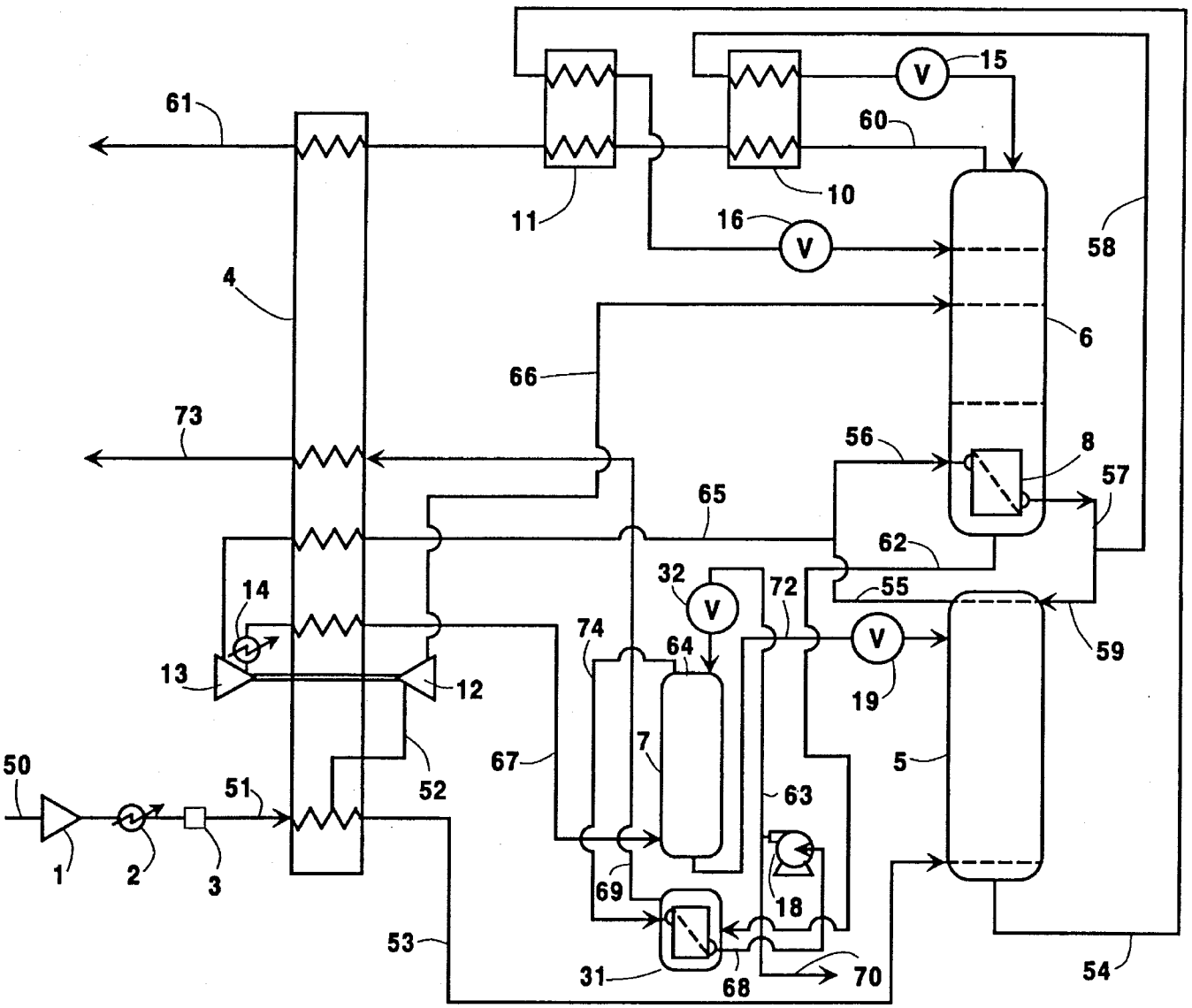
58
6
8
57
59
54
15
V
60
10
16
V
56
62
55
V
19
5
70
72
63
18
68
65
32
64
7
69
31
74
11
66
67
12
52
53
4
14
13
51
3
2
1
50
61
73

CRYOGENIC RECTIFICATION SYSTEM FOR PRODUCING GASEOUS OXYGEN AND HIGH PURITY NITROGEN

TECHNICAL FIELD

This invention relates generally to the cryogenic rectification of feed air. It is particularly advantageous for the production of lower purity oxygen.

BACKGROUND ART

The demand for lower purity oxygen is increasing in applications such as glassmaking, steelmaking and energy production. Lower purity oxygen is generally produced in large quantities by the cryogenic rectification of feed air in a double column wherein feed air at the pressure of the higher pressure column is used to reboil the liquid bottoms of the lower pressure column and is then passed into the higher pressure column.

In some situations it may be desirable to produce some high purity nitrogen in addition to gaseous oxygen product. Such dual product production cannot be efficiently accomplished with a conventional lower purity oxygen plant.

Accordingly, it is an object of this invention to provide a cryogenic rectification system which can effectively and efficiently produce both gaseous oxygen and high purity nitrogen.

SUMMARY OF THE INVENTION

The above and other objects, which will become apparent to one skilled in the art upon a reading of this disclosure, are attained by the present invention, one aspect of which is:

A cryogenic rectification method for the production of gaseous oxygen and high purity nitrogen comprising:

(A) passing feed air into a higher pressure column and separating the feed air within the higher pressure column by cryogenic rectification into oxygen-enriched liquid and into nitrogen-enriched fluid;

(B) passing oxygen-enriched liquid and a first portion of the nitrogen-enriched fluid into a lower pressure column and producing oxygen-richer liquid within the lower pressure column;

(C) passing a second portion of the nitrogen-enriched fluid from the higher pressure column into an auxiliary column comprising a condenser and producing nitrogen-richer vapor within the auxiliary column;

(D) passing oxygen-richer liquid from the lower pressure column into the condenser of the auxiliary column and therein vaporizing the oxygen-richer liquid by indirect heat exchange with nitrogen-richer vapor to produce gaseous oxygen and high purity nitrogen; and (E) recovering gaseous oxygen and high purity nitrogen from the auxiliary column.

Another aspect of the invention is:

A cryogenic rectification apparatus for the production of gaseous oxygen and high purity nitrogen comprising:

(A) a double column comprising a first column and a second column and means for passing feed air into the first column;

(B) an auxiliary column comprising a column section and a condenser and means for passing fluid from the first column into the column section;

(C) means for passing fluid from the first column into the second column;

(D) means for passing fluid from the lower portion of the second column into the condenser and means for passing fluid from the upper portion of the column section into the condenser; and (E) means for recovering product vapor and means for recovering co-product from the auxiliary column.

As used herein, the term "feed air" means a mixture comprising primarily oxygen and nitrogen, such as ambient air.

As used herein, the term "lower purity gaseous oxygen" means a gas having an oxygen concentration with the range of from 50 to 98.5 mole percent.

As used herein, the term "high purity nitrogen" means a fluid having a nitrogen concentration equal to or greater than 99 mole percent and having an oxygen concentration equal to or less than 0.10 mole percent.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.* The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein the term "condenser" means a heat exchange device which generates column downflow liquid from column vapor.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "recovered" means passed out of the system, i.e. actually recovered, in whole or in part, or otherwise removed from the system.

BRIEF DESCRIPTION OF THE DRAWING

The sole FIGURE is a schematic representation of a preferred embodiment of the invention.

DETAILED DESCRIPTION

The invention will be described in detail with reference to the Drawing.

Referring now to the FIGURE, feed air 50 is compressed to a pressure within the range of from 65 to 250 pounds per square inch absolute (psia) by passage through compressor 1, is cooled of the heat of compression in cooler 2, and is cleaned of high boiling impurities, such as water vapor and carbon dioxide, by passage through purifier 3. Resulting feed air stream 51 is passed into main heat exchanger 4 wherein it is cooled by indirect heat exchange against return streams. A portion 52 of the feed air is withdrawn after partial traverse of main heat exchanger 4, turboexpanded by passage through turboexpander 12 to generate refrigeration and then passed as stream 66 into lower pressure column 6. The major portion 53 of the feed air completely traverses main heat exchanger 4 and is then passed into higher pressure column 5.

Higher pressure or first column 5 is the higher pressure column of a double column which also includes lower pressure or second column 6. Higher pressure column 5 is operating at a pressure within the range of from 60 to 245 psia. Within higher pressure column 5 the feed air is separated by cryogenic rectification into oxygen-enriched liquid and nitrogen-enriched fluid. Oxygen-enriched liquid is withdrawn from the lower portion of higher pressure column 5 as stream 54, subcooled by passage through subcooler 11, and passed through valve 16 and into lower pressure column 6 which is operating at a pressure less than that of higher pressure column 5 and within the range of from 15 to 85 psia.

Nitrogen-enriched fluid is withdrawn from the upper portion of higher pressure column 5 as vapor stream 55. Some of vapor stream 55 is passed as stream 56 into main condenser 8 wherein it is condensed against reboiling lower pressure column 6 bottom liquid. Resulting liquid 57 is withdrawn from main condenser 8 and a first portion 58 of the nitrogen-enriched fluid is subcooled by passage through subcooler 10 and then passed through valve 15 and into lower pressure column 6 as reflux. Some of liquid 57 is passed as stream 59 into higher pressure column 5 as reflux.

Within lower pressure column 6 the various feeds are separated by cryogenic rectification into nitrogen vapor and oxygen-richer liquid. Nitrogen vapor is withdrawn from the upper portion of lower pressure column 6 as stream 60, warmed by passage through subcoolers 10 and 11 and main heat exchanger 4, and removed as stream 61 which may be recovered. Oxygen-richer liquid is withdrawn from the lower portion of lower pressure column 6 as stream 62, and passed into condenser 31 of auxiliary column 64 which comprises column section 7 and condenser 31.

Nitrogen-enriched fluid is passed from higher pressure column 5 into auxiliary column 64. The FIGURE illustrates a preferred embodiment of the invention wherein a second portion 65 of the nitrogen-enriched fluid is taken from stream 55, warmed by passage through main heat exchanger 4 and compressed by passage through compressor 13. Preferably, as illustrated in the FIGURE, compressor 13 is mechanically linked or coupled to turboexpander 12. The resulting compressed stream is cooled of the heat of compression in cooler 14, further cooled by passage through main heat exchanger 4 and then passed as stream 67 into column section 7.

Auxiliary column 64 is operating at a pressure within the range of from 65 to 250 psia. The nitrogen-enriched fluid passed into column section 7 in stream 67 rises up the auxiliary column against downflowing liquid and becomes progressively richer in nitrogen, forming nitrogen-richer vapor which is withdrawn from the upper portion of auxiliary column 64 as stream 74 and passed into condenser 31.

Within condenser 31 the oxygen-richer liquid is vaporized by indirect heat exchange with nitrogen-richer vapor to produce gaseous oxygen and high purity nitrogen co-product respectively. In a preferred embodiment of the invention the nitrogen-richer vapor condenses, at least in part, within condenser 31 so as to produce high purity liquid nitrogen. The gaseous oxygen produced in condenser 31 may be lower purity oxygen. Gaseous oxygen is withdrawn from condenser 31 as stream 69, warmed by passage through main heat exchanger 4 and recovered in stream 73 as gaseous oxygen product. The co-product high purity nitrogen may be recovered from the auxiliary column in liquid and/or gaseous form.

High purity nitrogen is withdrawn from condenser 31 as stream 68. In the embodiment illustrated in the FIGURE the high purity nitrogen in stream 68 is liquid and is passed through liquid pump 18. A portion of the high purity nitrogen is recovered as high purity nitrogen product in stream 70. Another portion of the high purity nitrogen is passed in stream 63 through valve 32 into the upper portion of auxiliary column 64 to serve as the aforesaid downflowing liquid. This liquid collects at the bottom of column section 7 and is passed in stream 72 through valve 19 and into the upper portion of higher pressure column 5 as additional reflux.

Although the invention has been described in detail with reference to one preferred embodiment, those skilled in the art will recognize that there are other embodiments of the invention within the spirit and the scope of the claims.

I claim:

1. A cryogenic rectification method for the production of gaseous oxygen and high purity nitrogen comprising:

(A) passing feed air into a higher pressure column and separating the feed air within the higher pressure column by cryogenic rectification into oxygen-enriched liquid and into nitrogen-enriched fluid;

(B) passing oxygen-enriched liquid and a first portion of the nitrogen-enriched fluid into a lower pressure column and producing oxygen-richer liquid within the lower pressure column;

(C) passing a second portion of the nitrogen-enriched fluid from the higher pressure column into an auxiliary column comprising a condenser and producing nitrogen-richer vapor within the auxiliary column;

(D) passing oxygen-richer liquid from the lower pressure column into the condenser of the auxiliary column and therein vaporizing the oxygen-richer liquid by indirect heat exchange with nitrogen-richer vapor to produce gaseous oxygen and high purity nitrogen; and (E) recovering gaseous oxygen and high purity nitrogen from the auxiliary column.

2. The method of claim 1 further comprising compressing the second portion of the nitrogen-enriched fluid prior to passing it into the auxiliary column.

3. The method of claim 2 further comprising turboexpanding a portion of feed air and passing the turboexpanded feed air into the lower pressure column wherein the turboexpansion of the feed air portion and the compression of the second portion of the nitrogen-enriched fluid are mechanically linked.

4. A cryogenic rectification apparatus for the production of gaseous oxygen and high purity nitrogen comprising:

(A) a double column comprising a first column and a second column and means for passing feed air into the first column;

(B) an auxiliary column comprising a column section and a condenser and means for passing fluid from the first column into the column section;

(C) means for passing fluid from the first column into the second column;

(D) means for passing fluid from the lower portion of the second column into the condenser and means for passing fluid from the upper portion of the column section into the condenser; and (E) means for recovering product vapor and means for recovering co-product from the auxiliary column.

5. The apparatus of claim 4 wherein the means for passing fluid from the first column into the auxiliary column section includes a compressor.

6. The apparatus of claim 5 further comprising a turboexpander mechanically coupled to the compressor.

* * * * *